US009144994B2

(12) United States Patent
Sudo et al.

(10) Patent No.: US 9,144,994 B2
(45) Date of Patent: Sep. 29, 2015

(54) PRINTING DEVICE AND PRINTING METHOD

(71) Applicant: SEIKO EPSON CORPORATION, Tokyo (JP)

(72) Inventors: Naoki Sudo, Nagano (JP); Mika Fujimori, Nagano (JP); Bunji Ishimoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/853,577

(22) Filed: Mar. 29, 2013

(65) Prior Publication Data

US 2013/0328958 A1 Dec. 12, 2013

(30) Foreign Application Priority Data

Jun. 11, 2012 (JP) ..... 2012-131635

(51) Int. Cl.
*B41J 2/21* (2006.01)

(52) U.S. Cl.
CPC . *B41J 2/21* (2013.01); *B41J 2/2107* (2013.01)

(58) Field of Classification Search
CPC ..... B41J 2/2132; B41J 2/21; B41J 2/2052; B41J 2/2054; B41J 2/2056; B41J 2/205; G06K 15/102
USPC ..... 347/15
See application file for complete search history.

(56) References Cited

U.S. PATENT DOCUMENTS

2003/0016261 A1 1/2003 Nitta et al.
2008/0238975 A1* 10/2008 Kawai ..... 347/15
2011/0234661 A1* 9/2011 Goto et al. ..... 347/9

FOREIGN PATENT DOCUMENTS

JP 07-237346 A 9/1995
JP 07237346 A * 9/1995
JP 2002-307671 A 10/2002

OTHER PUBLICATIONS

Furuya Masami, MachineTranslationof—JP07-237346, 1995.*
Furuya, Masami, MachineTranslationof—JP07-237346A, 1995.*

* cited by examiner

*Primary Examiner* — Geoffrey Mruk
*Assistant Examiner* — Scott A Richmond
(74) *Attorney, Agent, or Firm* — Global IP Counselors, LLP

(57) ABSTRACT

A printing device which prints onto a printing medium comprising: a printing head; a control section which moves the printing head in a scanning direction and relatively moves either of the head or the printing medium in a direction which intersects with the scanning direction; and a discharge control section, wherein the printing head is provided with a plurality of color nozzle rows which are arranged to line up in the intersecting direction and where a plurality of nozzles which discharge the same color of color ink are arranged in the intersecting direction for each of the color nozzles rows, and a black ink nozzle row which is a nozzle row, which is arranged to line up with the color nozzle rows and discharges black ink, and which has a black ink nozzle group of the same number as the number of rows of the color nozzles.

3 Claims, 8 Drawing Sheets

| | | | | | |
|---|---|---|---|---|---|
| 1 | 0 | 0 | 1 | 0 | 0 |
| 0 | 0 | 0 | 0 | 1 | 0 |
| 0 | 1 | 0 | 0 | 0 | 1 |
| 0 | 0 | 0 | 1 | 0 | 0 |
| 0 | 1 | 0 | 1 | 0 | 1 |
| 0 | 1 | 1 | 0 | 0 | 0 |

M1

| | | | | | |
|---|---|---|---|---|---|
| 0 | 0 | 1 | 0 | 0 | 1 |
| 1 | 1 | 0 | 1 | 0 | 1 |
| 0 | 0 | 1 | 1 | 1 | 0 |
| 1 | 1 | 1 | 0 | 0 | 1 |
| 1 | 0 | 0 | 0 | 1 | 0 |
| 1 | 0 | 0 | 0 | 1 | 1 |

M2

| | | | | | |
|---|---|---|---|---|---|
| 0 | 1 | 0 | 0 | 1 | 0 |
| 0 | 0 | 1 | 0 | 0 | 0 |
| 1 | 0 | 0 | 0 | 0 | 0 |
| 0 | 0 | 0 | 0 | 1 | 0 |
| 0 | 0 | 1 | 0 | 0 | 0 |
| 0 | 0 | 0 | 1 | 0 | 0 |

M3

Fig. 5

PRINTING DEVICE AND PRINTING METHOD

CROSS-REFERENCE TO RELATED APPLICATIONS

This application claims priority to Japanese Patent Application No. 2012-131635 filed on Jun. 11, 2012. The entire disclosure of Japanese Patent Application No. 2012-131635 is hereby incorporated herein by reference.

BACKGROUND

1. Technical Field

The present invention relates to a printing device and a printing method.

2. Background Technology

A printer is known which is mounted with a printing head, which has nozzle rows which respectively discharge chromatic color inks such as cyan, magenta, and yellow and a nozzle row which discharges a non-chromatic color ink such as black. In such a printer, due to scanning with regard to a region which is a printing medium (movement which accompanies discharging of ink, also referred to as a pass) using each of the nozzle rows, a color image is realized in the region. As a related technique, an ink jet recording method is known (refer to Patent Document 1) where recording of cyan is performed from a color recording head in one scan, recording of 50% of the total number of dots of data for recording black is performed from a black recording head at the same time, recording of magenta and the remaining 50% of the black is performed in the second scan in a region where the recording of the cyan and black were performed in the first scan, and further recording of yellow is performed in the third scan in the region.

Japanese Laid-open Patent Publication No. H7-237346 (Patent Document 1) is an example of the related art.

SUMMARY

Problems to be Solved by the Invention

In the printer as described above, color development due to each of the inks, which have landed on the recording medium, influences each other in a case where a plurality of colors of inks are discharged together onto the printing medium in one scan of the printing head. Specifically, chromatic color inks differ in the degree of color development due to the amount of black ink which is discharged together with the chromatic color inks. In addition, there are differences between each of the chromatic color inks in terms of the degree of influence due to the black ink which is discharged together with the chromatic color inks. Accordingly, it is necessary for the amount of ink of the black ink, which is discharged along with the chromatic color inks which are particularly susceptible to such influences, to be appropriately controlled. In addition, it is necessary to comprehensively control the amount of ink of the black ink which is discharged along with each of the chromatic color inks so that dispersion in the degree of color development in each of the chromatic color inks is not generated on the printing medium.

The invention is carried out in order to solve the problems described above and provides a printing device and a printing method where it is possible to obtain a printing result with higher image quality than in the art by realizing improvement of color development and suppression of irregularities of ink which is discharged onto the printing medium.

Means Used to Solve the Above-Mentioned Problems

One aspect of the invention is a printing device which prints onto a printing medium and which has a printing head, a control section which moves the printing head in a scanning direction and relatively moves either of the head or the printing medium in a direction which intersects with the scanning direction, and a discharge control section, wherein the printing head is provided with a plurality of color nozzle rows which are arranged to line up in the intersecting direction and where a plurality of nozzles which discharge the same color of color ink are arranged in the intersecting direction for each of the color nozzles rows, and a black ink nozzle row which is a nozzle row, which is arranged to line up with the color nozzle rows and discharges black ink, and which has a black ink nozzle group of the same number as the number of rows of the color nozzles, and the amount of ink, which the discharge control section discharges from the black ink nozzle group which is arranged in a first color nozzle row which discharges color ink with the highest brightness out of the plurality of color inks, with regard to a predetermined range on the printing medium which corresponds to the transport amount for each transportation, for each movement of the printing head or the printing medium by the control section, is smaller than the amount of ink, which is discharged from the black ink nozzle group which is arranged in a second color nozzle row which is different to the first color nozzle row.

The bright chromatic color ink has the characteristic of it being easy to lower color development on the printing medium due to the influence of the non-chromatic color ink which has been discharged together with the chromatic color ink. According to the invention, the amount of ink ($\neq 0$) of the non-chromatic color ink, which is discharged along with the chromatic color ink with the highest brightness out of the plurality of chromatic color inks which are able to be discharged by the printing head, is smaller than the amount of ink of the non-chromatic color ink which is discharged along with a different chromatic color ink. As such, it is possible to avoid the degree of color development being significantly suppressed due to the influence of the non-chromatic color ink which is discharged together with the chromatic color ink with the highest brightness. That is, according to the invention, it is possible to secure excellent balance of the color development of each of the chromatic color inks and obtain a high quality printing result with minimal color irregularities as a result of the amount of ink of the non-chromatic color ink which is discharged together with the chromatic color inks being lower for the chromatic color ink with a higher brightness.

One aspect of the invention is a configuration where the first color nozzle row discharges yellow ink. That is, the chromatic color ink with the highest brightness described above is yellow ink. Yellow ink has a large degree of reduction in color development which is observed compared to the other chromatic color inks in a case of being discharged onto the printing medium along with the non-chromatic color ink. In other words, it is easy for the yellow color of yellow ink which has landed on the printing medium along with the non-chromatic color ink to be erased by the non-chromatic color ink. As a result, according to the configuration, it is possible to appropriately avoid a reduction in the degree of color development of yellow ink.

One aspect of the invention is where cyan ink and magenta ink are included in the plurality of color inks and the amount of ink which is discharged from the black ink nozzle group which is arranged to line up in the second color nozzle row where cyan ink is discharged with regard to the predetermined range is equal to or more than the amount of ink which is discharged from the black ink nozzle group which is arranged to line up in the first color nozzle row with regard to the predetermined range and is smaller than the amount of ink which is discharged from the black ink nozzle group which is arranged to line up in the second color nozzle row where magenta ink is discharged with regard to the predetermined range. That is, when comparing the brightness of each of the inks of cyan, magenta, and yellow, brightness of yellow ink>brightness of cyan ink>brightness of magenta ink. As a result, the amount of ink of the non-chromatic color which is discharged along with the each of the inks of yellow, cyan, and magenta is set so that the amount of ink of the non-chromatic color ink which is discharged along with the yellow ink≤the amount of ink of the non-chromatic color ink which is discharged along with the cyan ink<the amount of ink of the non-chromatic color ink which is discharged along with the magenta ink.

One aspect of the invention is a configuration where the first chromatic color nozzle row and a second chromatic color nozzle row are arranged in parallel to the non-chromatic color nozzle row and arranged to deviate in a row tangential direction, and the amount of ink of the non-chromatic color ink which is discharged from a first non-chromatic color nozzle group, which is configured from a portion of the non-chromatic nozzle row to pair up with the first chromatic color ink row, is smaller than the amount of ink of the non-chromatic ink which is discharged from a second non-chromatic color nozzle group, which is configured from a portion of the non-chromatic nozzle row to pair up with the second chromatic color ink row. According to the configuration, it is possible to secure excellent balance of the color development of each of the chromatic color inks and obtain a high quality printing result with minimal irregularities by the amount of ink of the non-chromatic color ink which is discharged together with the chromatic color inks being lower for the chromatic color inks with high brightness in a case where recording with ink is performed in a common range due to a scan using the first chromatic color nozzle row and the first non-chromatic color nozzle group and a scan using the second chromatic color nozzle row and the second non-chromatic color nozzle group.

One aspect of the invention is where the printing head is able to discharge ink in each of an outgoing path movement and a return path movement along the first direction and sets the total amount of the amount of ink of the black ink which is discharged from the black ink nozzle row in accompaniment with the outgoing path movement with regard to the predetermined range to be substantially the same as the total amount of the amount of ink of the black ink which is discharged from the black ink nozzle row in accompaniment with the return path movement. It is possible for color irregularities to be generated on the printing medium caused by reversing of the landing order since the ordering with which the chromatic color ink and the non-chromatic color ink land is reversed with regard to the printing medium in the outgoing path movement and the return path movement. However, according to the configuration, color irregularities are alleviated in the common range since there is substantially no bias with regard to the common range between the total amount of ink of the non-chromatic color ink which is discharged from the non-chromatic color ink nozzle in the outgoing path movement and the total amount of ink of the non-chromatic color ink which is discharged from the non-chromatic color ink nozzle in the return path movement.

One aspect of the invention is where a pass process, where chromatic color ink is discharged from either one of a plurality of the chromatic color nozzle rows along with discharging of black ink from the black ink nozzle row with regard to the predetermined range in accompaniment with the movement, is executed with regard to the predetermined range a number of times which is an integer of the number of color inks, and each of the amount of ink which is discharged from the black ink nozzle row in the first pass process and the amount of ink which is discharged from the black ink nozzle row in the last pass process with regard to the predetermined range are smaller than the amount of ink which is discharged from the black ink nozzle group with regard to the predetermined range of at least one of the pass processes which is not the first or the last pass. There are slight positional deviations generated caused by small errors in the transport amount of the printing medium, small errors in the recording positions due to the printing head, and the like in each of the images which are recorded in each of the pass processes. It is easy for the positional deviations to most remarkably appear in the images which are recorded in the first pass process and the last process. However, according to the configuration, it is possible to alleviate influence on image quality due to the positional deviations (blurring in the printing result) since the amount of ink of the non-chromatic color ink which is discharged from the non-chromatic color ink row in the first pass process is smaller than the amount of ink of the non-chromatic color ink which is discharged from the non-chromatic color ink row in the last pass process.

The technical concept according to the invention is not realized only in the format of the printing device and can be implemented using other objects (devices). In addition, it is possible to also grasp an invention of a method (printing method) where processes which correspond to the characteristics of any of the aspects of the printing device described above are provided, an invention of a program where the method is executed by predetermined hardware (a computer), and an invention of a recording medium which is able to be read out by a computer where the program is recorded. In addition, the printing device can be realized using a single device or can be realized using a combination of a plurality of devices.

BRIEF DESCRIPTION OF THE DRAWINGS

Referring now to the attached drawings which form a part of this original disclosure:

FIG. 5 is a diagram illustrating an example of a nozzle group mask;

DETAILED DESCRIPTION OF EXEMPLARY EMBODIMENTS

Below, an embodiment of the invention will be described while referencing the diagrams

1. Outline of Device

Figure 1:
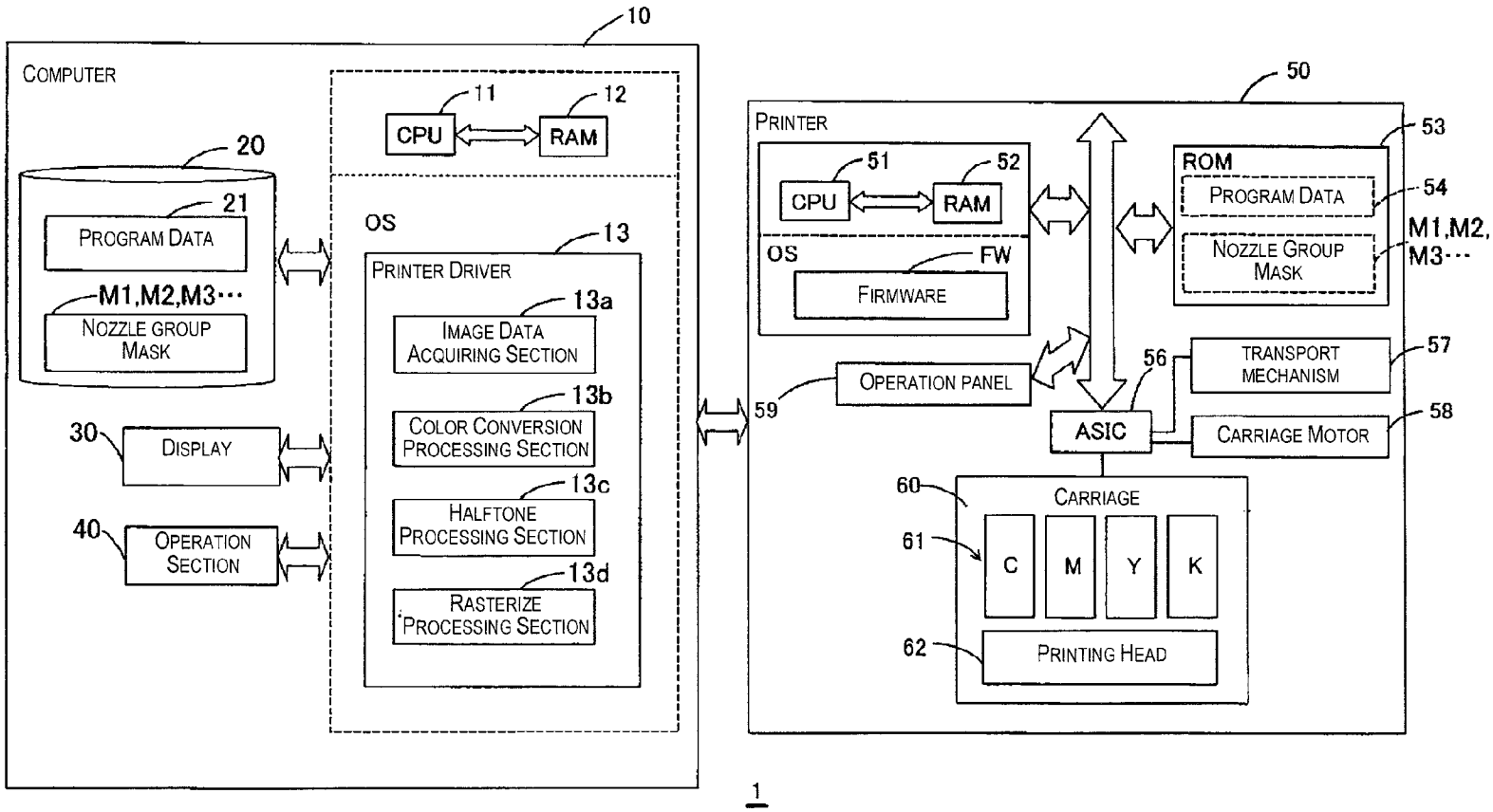
FIG. 1 is a diagram illustrating a hardware configuration and a software configuration.

FIG. 1 schematically illustrates a hardware configuration and a software configuration according to the present embodiment. In FIG. 1, a computer 10 and a printer 50 are shown as a personal computer (PC). A combination of the computer 10 and the printer 50 or the printer 50 is equivalent to a printing device or a printing control device. In addition, the computer 10 and the printer 50 refer to a configuration of one printing system 1. In the computer 10, a printer driver 13 for controlling the printer 50 is executed by a CPU 11 performing a calculation in accordance with program data 21 under an OS by the program data 21 which is stored in a hard disk drive (HDD) 20 or the like being developed in a RAM 12. The printer driver 13 is a program for the CPU 11 to execute each function of an image data acquiring section 13*a*, a color conversion processing section 13*b*, a halftone (HT) processing section 13*c*, a rasterize processing section 13*d*, or the like. Each of the functions will be described later.

A display 30 is connected in the computer 10 as a display section and user interface (UI) screens which are necessary for each process are displayed in the display 30. In addition, the computer 10 is appropriately provided with, for example, an operation section 40 which is realized using a keyboard, a mouse, a touch pad, a touch panel, or the like, and instructions which are necessary for each process are input by a user via the operation section 40. In addition, the printer 50 is connected to the computer 10. As will be described later, in the computer 10, a printing command is generated based on image data which expresses a printing target image and the printing command is transmitted with regard to the printer 50 using a function of the printer driver 13.

In the printer 50, firmware FW for controlling the device itself is executed by a CPU 51 performing a calculation in accordance with program data 54 under an OS by the program data 54 which is stored in a memory such as a ROM 53 being developed in a RAM 52. The firmware FM extracts drive data by analyzing the printing command which is transmitted from the computer 10 and it is possible to execute printing based on the drive data by sending the drive data to an ASIC 56. In addition, the firmware FW obtains image data which expresses the printing target image from a memory card which is mounted into a connector for external connection which is not shown in the diagram, an external device (for example, the computer 10), and the like, and it is possible to generate drive data based on the image data which has been obtained. In this manner, the drive data is sent to the ASIC 56 even in a case where the drive data is generated using the functions of the firmware FW.

The ASIC 56 obtains the drive data and generates a drive signal for driving a transport mechanism 57, a carriage motor 58, and a printing head 62 based on the drive data. The printer 50 is provided with a carriage 60 and the carriage 60 is mounted with ink cartridges 61 for each of a plurality of types of ink. In an example in FIG. 1, the ink cartridges 61 are mounted to correspond to each type of ink of cyan (C), magenta (M), yellow (Y), and black (K).

Here, the specific types and number of inks which are used by the printer 50 are not limited to those described above, and for example, it is possible to use various inks such as light cyan, light magenta, orange, green, gray, light gray, white, and metallic ink. In addition, the ink cartridges 61 can be disposed at a predetermined position in the printer without being mounted in the carriage 60. The carriage 60 is provided with the printing head 62 which ejects (discharges) ink, which is supplied from each of the ink cartridges 61, from a plurality of nozzles.

Figure 2:
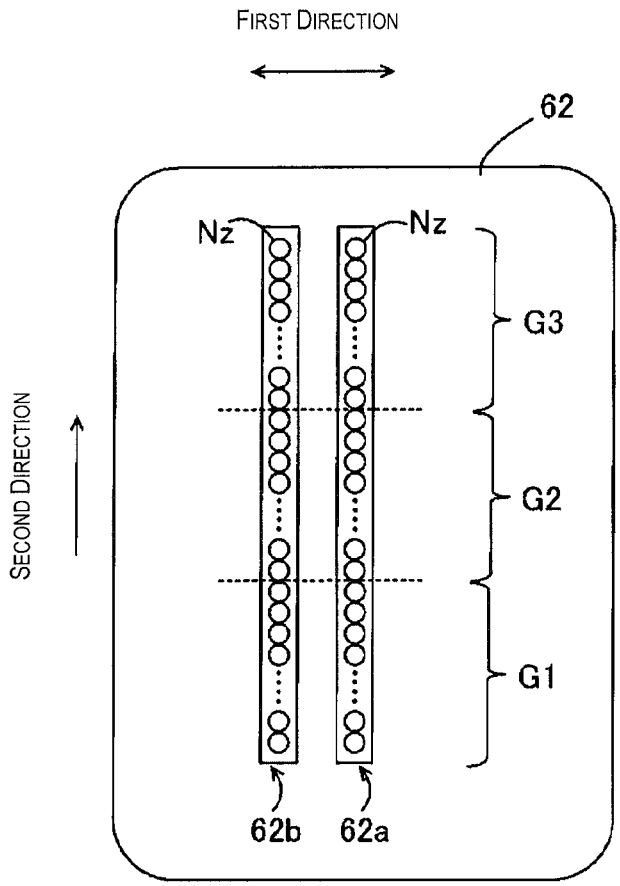
FIG. 2 is a diagram which exemplifies a nozzle alignment in a printing head.

FIG. 2 uses an alignment of nozzles on a lower surface of the printing head 62 (a surface which opposes a printing medium) as an example. A non-chromatic color nozzle row 62*a* which is formed from a plurality of nozzles Nz (K nozzles) for discharging K inks as non-chromatic inks and a chromatic color nozzle row 62*b* which is formed from the plurality of nozzles Nz (K nozzles) for discharging CMY inks as chromatic inks are formed in the lower surface of the printing head 62. The non-chromatic color nozzle row 62*a* and the chromatic color nozzle rows 62*b* are parallel to each other and are each configured by the plurality of nozzles Nz which are arranged in rows along a second direction which is substantially orthogonal with regard to a first direction (refer to FIG. 2). The first direction is the main scanning direction of the printing head 62 and the second direction is the transport direction of the printing medium in the printer 50. In addition, the second direction is also referred as the sub-scanning direction.

The density of the nozzles Nz (number of nozzles per inch) in each of the non-chromatic color nozzle row 62*a* and the chromatic color nozzle rows 62*b* is the same as the printing resolution (dpi) of the printer 50 in the sub-scanning direction. Here, the non-chromatic color nozzle row 62*a* and the chromatic color nozzle rows 62*b* are not just configured by only a nozzle row which is one row which is lined up along the sub-scanning direction and can be configured, for example, by a plurality of rows of nozzle rows which are parallel and are deviated by a predetermined pitch in the sub-scanning direction. The chromatic color nozzle row 62*b* further includes a nozzle row (C nozzle row) which is formed from the plurality of nozzles Nz (C nozzles) for discharging C ink, a nozzle row (M nozzle row) which is formed from the plurality of nozzles Nz (M nozzles) for discharging M ink, and a nozzle row (Y nozzle row) which is formed from the plurality of nozzles Nz (Y nozzles) for discharging Y ink. In other words, the C nozzle row, the M nozzle row, and the Y nozzle row are formed to be deviated from each other in a tangential direction thereof and the entirety configures the chromatic color nozzle row 62. The C nozzle row, the M nozzle row, and the Y nozzle row each have the same number of nozzles Nz.

Furthermore, each of the C nozzle row, the M nozzle row, and the Y nozzle row are configured by nozzles groups G1, G2, and G3 along with a portion which is a portion of the non-chromatic color nozzle row 62*a* and forms a pair. Here, "form a pair" has a meaning of being accommodated within the same range in the sub-scanning direction. Specifically, the C nozzle row and a portion, which is a portion of the non-chromatic color nozzle row 62*a* and forms a pair with the C nozzle row, configure the nozzle group G1. In the same manner, the M nozzle row and a portion, which is a portion of the non-chromatic color nozzle row 62*a* and forms a pair with the M nozzle row, configure the nozzle group G2, and the Y nozzle row and a portion, which is a portion of the non-chromatic color nozzle row 62*a* and forms a pair with the Y nozzle row, configure the nozzle group G3. Here, in the present embodiment, since the Y ink is equivalent to the ink with the highest brightness out of the chromatic color inks (the CMY inks), the Y nozzle row is equivalent to the first chromatic color nozzle row, and the C nozzle row and the M nozzle row are each equivalent to the second chromatic color nozzle row. In addition, the portion which includes the nozzle group G3 out of the non-chromatic color nozzle row 62*a* is equivalent to the first non-chromatic color nozzle group and a portion or the entirety of the portion other than the nozzle group G3 out of the non-chromatic color nozzle row 62*a* is equivalent to the second non-chromatic color nozzle group.

In the printing head 62, it is possible to print regions (bands) which have a constant width in the sub-scanning direction on the printing medium using each of the nozzle groups G1, G2, and G3. That is, a color image using CMYK is completed in one of the bands by printing being performed using each of the nozzle groups G1, G2, and G3 with regard to one band. The width of one band is equivalent to the length of one nozzle group (the length in the sub-scanning direction). In addition, one band is equivalent to the predetermined range in the claims (also referred to below as the common range).

Inside of the printing head 62, piezoelectric elements for ejecting ink droplets (dots) from the nozzles are provided with regard to each of the nozzles. The piezoelectric elements change shape when the drive signal is applied and dots are ejected from the corresponding nozzles. The transport mechanism 57 (FIG. 1) is provided with a paper feeding motor and a paper feeding roller which are not shown in the diagram and transports the printing medium along the sub-scanning direction due to driving control by the ASIC 56. It is possible for the transport mechanism 57 to perform transporting to the extent of the width of the band in order to perform printing with regard to the same band using each of the nozzle groups G1, G2, and G3.

The carriage 60 (and the printing head 62) moves along the main scanning direction due to driving of the carriage motor 58 being controlled by the ASIC 56 and ink is discharged from each of the nozzles at a predetermined timing in the printing head 62 in accompaniment with the movement using the ASIC 56. Due to this, dots are landed on the printing medium and the printing target image which is expressed in the printing control is reproduced on the printing medium. The printer 50 is further provided with an operation panel 59. The operation panel 59 includes a display section (for example, a liquid crystal panel), a touch panel which is formed in the display section, and various types of buttons and keys, receives inputs from a user, and displays necessary UI screens on the display section.

The configuration described above is assumed in the present embodiment and processes where the printing target image is printed using the printer 50 will be described below. In the printing, recording is performed by a number of passes of an integer number (including one) which is the number of chromatic inks. One pass (a pass process) has the meaning of a process where the printing head 62 discharges ink in accompaniment with either one of one outgoing path movement or one return path movement in the scanning direction.

2. Printing Control Process

Figure 3:
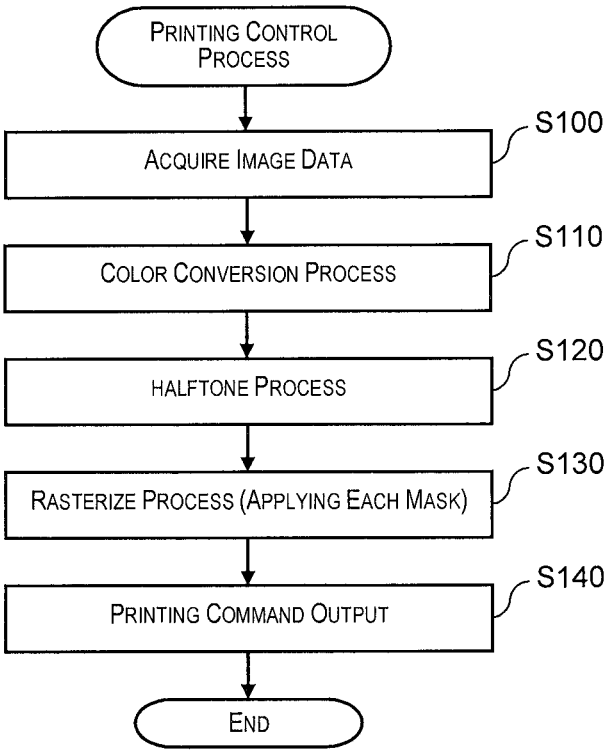
FIG. 3 is a flow chart which exemplifies a printing control process.

FIG. 3 shows a printing control process using a flow chart. Here, there will be description of the CPU 11 executing the flow chart using the printer driver 13 (the printing control program). The printer driver 13 receives selection of an arbitrary printing target image by a user via the operation section 40 with the assumption that the flow chart will be initiated.

In step S100, the image data acquiring section 13*a* acquires the image data which expresses the printing target image from a predetermined storage region such as the HDD 20 or a memory card which is mounted into the connector for external connection which is not shown in the diagram. Here, the image data is RGB data where each pixel which configures the image has a gradient value for each of red (R), green (G), and blue (B) (for example, 256 gradients of 0 to 255). Here, in a case where the image data is a file which is written in a format such as PDL, the image data acquiring section 13*a* develops the RGB data by analyzing the file. Furthermore, the image data acquiring section 13*a* appropriately executes a resolution conversion process for matching the RGB data with the printing resolution in the printer 50.

In step S110, the color conversion processing section 13*b* color converts the RGB data which has been acquired by the image data acquiring section 13*a* using a color conversion look up table (LUT) which is stored in advance in the HDD 20 or the like. The color conversion LUT specifies the corresponding relationship of an input table color system (the RGB table color system) and an output table color system (the ink amount space which corresponds to the type of ink which is used in the printer 50) as a plurality of input grid points. In the case of the present embodiment, ink amounts (gradient values) are specified in the color conversion LUT with regard to each of the C, M, Y, and K inks as output values which correspond to each of the input grid points. At the time of color conversion, an interpolation calculation or the like is executed as required. As a result, the RGB data is converted to ink amount data where there are gradient values (for example, 256 gradient values of 0 to 255) for each of C, M, Y, and K for each pixel.

In step S120, the HT processing section 13*c* generates halftone data which specifies recording (ON) or non-recording (OFF) of dots for each type of ink and each pixel by executing a halftone process with regard to the ink amount data. The halftone process is executed using a known technique such as a dither method or an error diffusion method.

In step S130, the rasterize processing section 13*d* generates a printing command which includes drive data, where the order has been arranged to transfer the halftone data to the printer 50, by information for each type of ink and each pixel in the halftone data being allocated to each pass and each nozzle of the printing head 62 (rasterize process). That is, according to the rasterize process, each of the dots which are specified in the halftone data is confirmed as to on which pass and from which nozzle the dots are formed according to the pixel positions and the types of ink. Here, in step S130, the timing of the recording of each of the dots is allocated (dispersed) to a plurality of passes by applying nozzle group masks M1, M2, M3, . . . (written as masks M1, M2, M3, . . . below) which are stored in advance in the HDD 20 or the like with regard to the K ink halftone data out of the halftone data for each type of ink.

Figure 4:
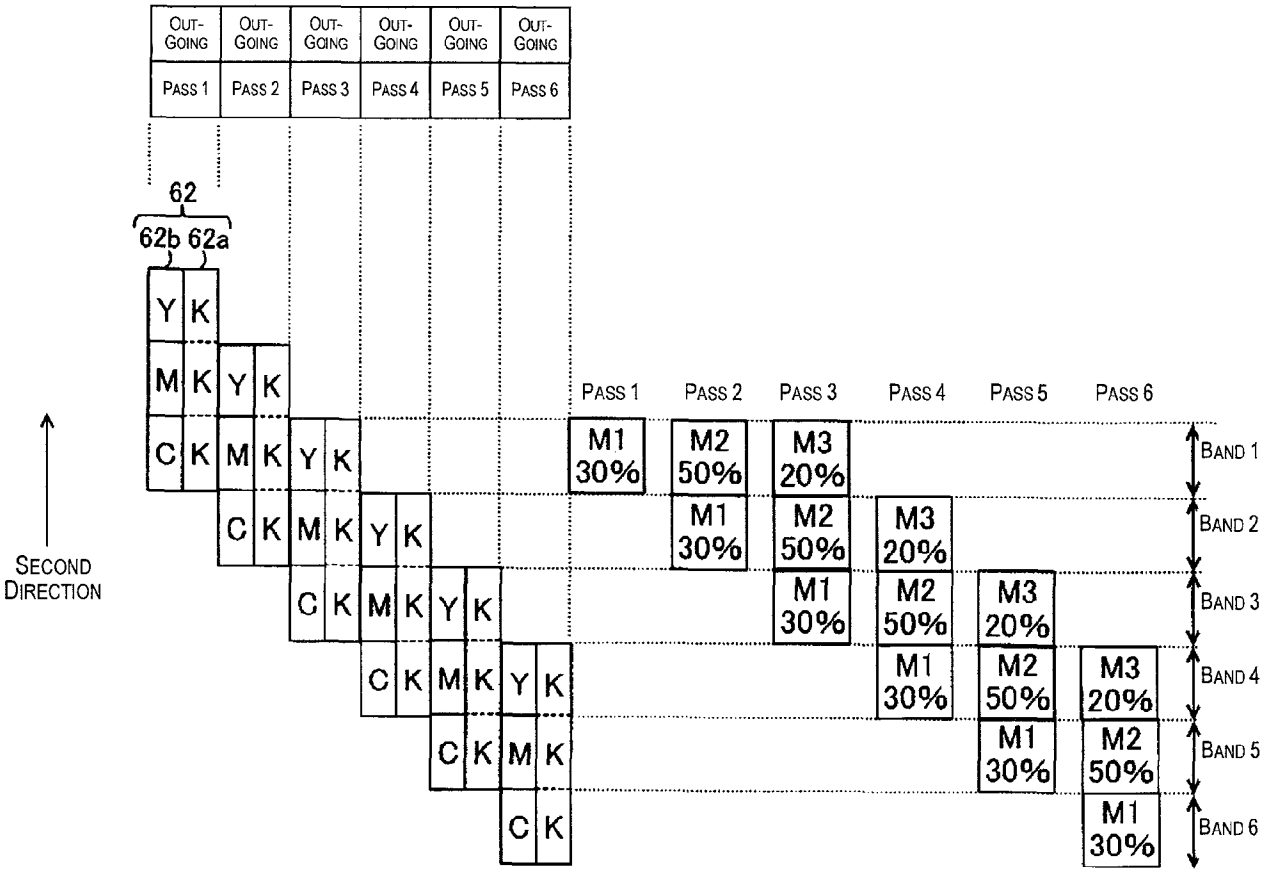
FIG. 4 is a diagram for describing an example of allocation of halftone data with regard to each pass and each nozzle.

FIG. 4 is a diagram for describing an example of allocation of the halftone data with regard to each pass and each nozzle of the printing head 62 described above. In FIG. 4, a state is shown on the left side where the position of the printing head 62 relatively changes with regard to the printing medium for each one pass, and here, a total of six passes of passes 1 to 6 are exemplified. In addition, in FIG. 4, a portion which is marked with "C" (the C nozzle row) in the chromatic color nozzle row 62*b* and a portion of the non-chromatic color nozzle row 62*a* which is marked as "K" and forms a pair with the "C" portion are equivalent to the nozzle group G1. In the same manner, an "M" portion (the M nozzle row) in the chromatic color nozzle row 62*b* and a portion of the non-chromatic color nozzle row 62*a* which is marked as "K" and forms a pair with the "M" portion are equivalent to the nozzle group G2, and a "Y" portion (the Y nozzle row) in the chromatic color nozzle row 62*b* and a portion of the non-chromatic color nozzle row 62*a* which is marked as "K" and forms a pair with the "Y" portion are equivalent to the nozzle group G3.

In addition, on the right side of FIG. 4, positions of each band (band 1 to 6) on the printing medium, where there is the recording by each pass described above, are exemplified. Here, in FIG. 4 (and FIGS. 7 and 8 which will be described later), a relative positional change between the printing head 62 and the printing medium is shown by the position of the printing head 62 being changed to the reverse direction to the second direction for ease of description, but in practice, the printing medium is moved in the second direction by being transported as described above without the printing head 62 being moved along the first direction. Furthermore, in FIG. 4, a state is shown where there is allocation to three passes by applying the masks M1, M2, and M3 to the K ink halftone data for printing of each of the bands in the vicinity of the center.

FIG. 5 shows an example of the masks M1, M2, and M3 which are used in the present embodiment. Each of the masks are the same size which has a predetermined number of pixels vertically and horizontally and respectively maintain a "0" or a "1" in each of the pixels. The pixel positions of "1" which is respectively maintained by each of the pixel are different to each other and are configured so that all of the pixels are "1" when each and all of the masks are combined (overlapped). "1" in each of the masks has the meaning that the dot in that position is allocated to the nozzle group which corresponds to the mask. The mask M1 is for the nozzle group G1, the mask M2 is for the nozzle group G2, and the mask M3 is for the nozzle group G3, and each of the masks are prepared in advance. In the embodiment, the masks M1, M2, and M3 are different to each other in terms of the proportion of "1" and the proportion is the largest in the case of the mask M2 and is approximately 50% for all of the pixels, is the next largest in the case of the mask M1 and is approximately 30% for all of the pixels, and is the smallest in the case of the mask M3 and is approximately 20% for all of the pixels.

According to FIGS. 4 and 5, the K ink halftone data for printing the band 1 is allocated to the first pass (pass 1) out of the three passes where the result of the mask M1 being applied is that band 1 will be printed, is allocated to the second pass (pass 2) where the result of the mask M2 being applied is that band 1 will be printed, and is allocated to the third pass (pass 3) where the result of the mask M3 being applied is that band 1 will be printed. As a result, the K ink halftone data for printing the band 1 is allocated so that approximately 30% of the dots are allocated to the K nozzle of the nozzle group G1 in pass 1, approximately 50% of the dots are allocated to the K nozzle of the nozzle group G2 in pass 2, and approximately 20% of the dots are allocated to the K nozzle of the nozzle group G3 in pass 3 (all of the pixels in the halftone data are assumed to be a case where the dots are ON (that is, a solid image), and the same applied below).

The same considerations are given to the other bands, and for example, the K ink halftone data for printing the band 2 is allocated to the nozzle group G1 in the first pass (pass 2) out of the three passes where the result of the mask M1 being applied (approximately 30% of the dots) is that band 2 will be printed, is allocated to the nozzle group G2 in the second pass (pass 3) where the result of the mask M2 being applied (approximately 50% of the dots) is that band 2 will be printed, and is allocated to the nozzle group G3 in the third pass (pass 4) where the result of the mask M3 being applied (approximately 20% of the dots) is that band 2 will be printed.

Here, in the example of FIG. 4 (and of FIG. 7 which will be described later), the halftone data for each type of ink (CMY) other than K ink is 100% allocated to one pass, which is printed by the nozzle group which has the nozzle row of the corresponding type of ink, out of the plurality of number of passes which prints one band. For example, 100% of the dots of the C ink halftone data for printing the band 1 are allocated to the C nozzle in the nozzle group G1 in pass 1, 100% of the dots of the M ink halftone data for printing the band 1 are allocated to the M nozzle in the nozzle group G2 in pass 2, and 100% of the dots of the Y ink halftone data for printing the band 1 are allocated to the Y nozzle in the nozzle group G3 in pass 3. In addition, in the example of FIG. 4, all of the passes are set as outgoing path movements. Selection of uni-directional direction printing (printing which is performed with either pass of the outgoing path movement or the return path movement of the printing head 62) or bi-directional printing (printing which is performed using the outgoing path movement and the return path movement of the printing head 62) is set according to an operation in advance by a user or the like.

The printing command which has been generated due to the rasterize process described above is output to the printer 50 (step S140). As a result, the printer 50 executes printing of the printing target image with regard to the printing medium based on the printing command which has been transmitted. In this case, the printer 50 completes an image which is formed from a plurality of bands by dots for each type of ink being allocated to each pass and each nozzle of the printing head 62 as described above and the dots being discharged.

According to the invention, the amount of ink of the K ink, which is discharged along with the Y ink with the highest brightness out of the chromatic color inks which are able to be printed by the printing head 62, is smaller than the amount of ink of the K ink which is discharged along with the other chromatic color inks (the C ink and the M ink) in a case of printing a band on the printing medium using a plurality of passes by the printing head 62. Accordingly, it is possible to avoid the color development of the Y ink with the highest brightness on the printing medium being suppressed more than necessary due to considerable influence of the K ink which is discharged together with the Y ink.

More specifically, in the present embodiment, in a case of printing one band using each of the nozzle groups G1, G2, and G3, the amount of the K ink which is discharged using the nozzle group G3 (the K ink which is discharged together with the Y ink in the same pass) is the smallest, the amount of the K ink which is discharged using the nozzle group G1 (the K ink which is discharged together with the C ink in the same pass) is the next smallest, and the amount of the K ink which is discharged using the nozzle group G2 (the K ink which is discharged together with the M ink in the same pass) is the largest. That is, since the amount of ink of the K ink which is discharged together with the chromatic color ink with high brightness is small, it is possible to secure excellent balance of the color development of each of the chromatic color inks and obtain a high quality printing result with minimal differences in dark and light (color irregularities) between the chromatic color inks.

3. MODIFIED EXAMPLES

The invention is not limited to the embodiment described above and it is possible for the invention to be realized in various formats in the scope which does not depart from the gist thereof. For example, modified examples such as the following are also possible. Below, mainly points which are different to the embodiment described above will be described. In addition, the content where the embodiment described above and the modified examples are appropriately combined is in the scope of the disclosure of the invention.

Modified Example 1

In the embodiment described above, description is performed with the assumption of a case of uni-directional printing, but it is possible for the invention to be also applied to bi-directional printing. Here, since the landing order of the dots with regard to the printing medium in the outgoing path movement and the return path movement is reversed in bi-directional printing, a problem of color irregularities caused by reversal occurs.

Figure 6A:
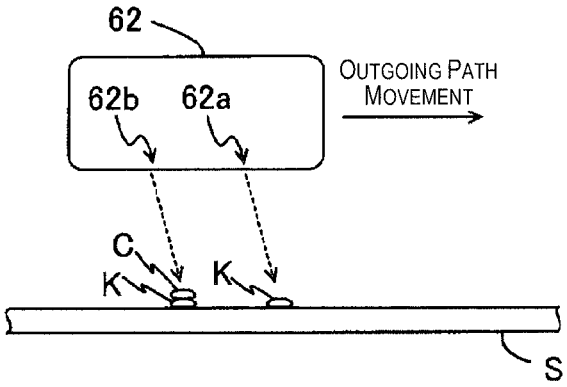
FIGS. 6A and 6B are diagrams for describing reversal of the landing order of dots according to bi-directional printing.
Figure 6B:
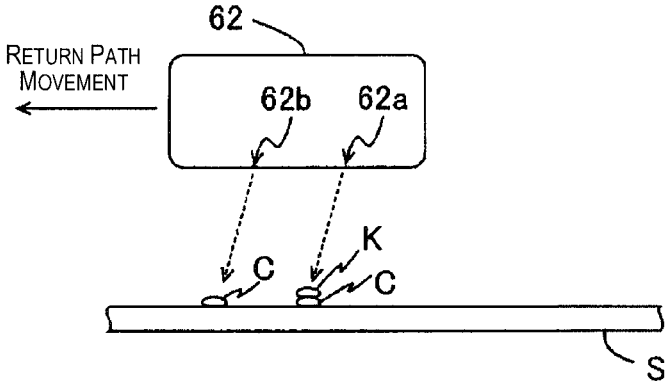

FIGS. 6A and 6B are diagrams for simply describing reversal of the dots and show the positional relationship of the printing head 62 and a printing medium S from a visual point in the transport direction of the printing medium. In FIG. 6A, a state is shown where the dots are discharged from the non-chromatic color nozzle row 62*a* and the chromatic color nozzle row 62*b* with regard to the printing medium S during the outgoing path movement of the printing head 62. According to the example of FIG. 6A, the K ink dots land beforehand on the printing medium S and the chromatic color inks dots (for example, the C ink) land on the K ink dots since the non-chromatic color nozzle row 62*a* is positioned in front of the chromatic color nozzle row 62*b* in the movement direction. On the other hand, in FIG. 6B, a state is shown where the dots are discharged from the non-chromatic color nozzle row 62*a* and the chromatic color nozzle row 62*b* with regard to the printing medium S during the return path movement of the printing head 62. According to the example of FIG. 6B, the chromatic color ink dots (for example, the C ink) land beforehand on the printing medium S and the K ink dots land on the chromatic color ink dots since the non-chromatic color nozzle row 62*a* is position behind the chromatic color nozzle row 62*b* in the movement direction.

In this manner, the color tone which is recognized by a user is not the same in locations where the chromatic color inks land after the K ink and locations where the chromatic color inks land before the K ink. Specifically, the influence of the color of ink which has landed first is stronger. As a result, when the locations where the landing order of the dots is reversed are arranged into lines on the printing medium, color irregularities are generated according to the state of the line arrangements. Therefore, in this modified example, there is a design where color irregularities caused by the reversal are suppressed.

Figure 7:
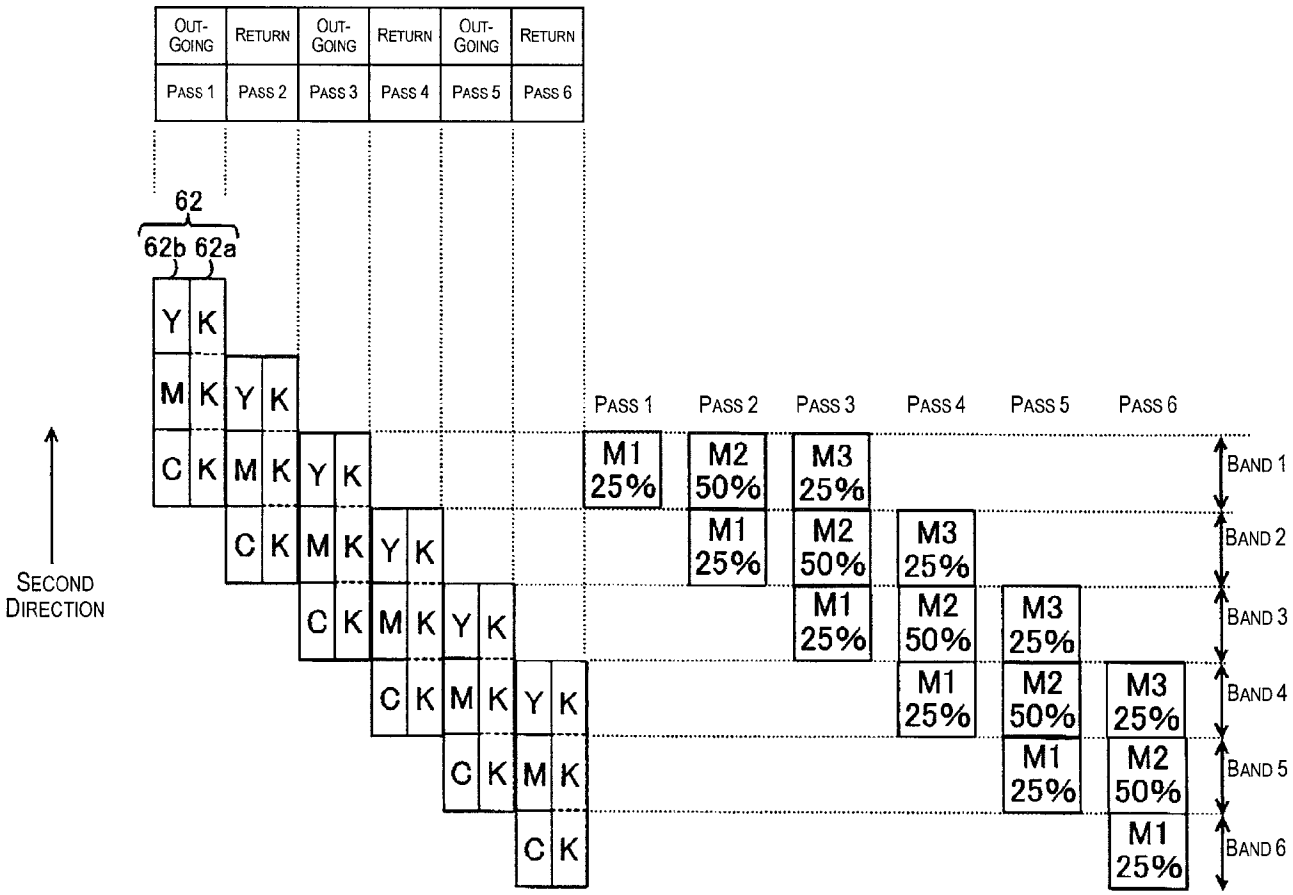
FIG. 7 is a diagram for describing another example of allocation of halftone data with regard to each pass and each nozzle.

FIG. 7 is a diagram for describing an example of allocation of the halftone data with regard to each pass and each nozzle of the printing head 62 described above and shows an example which is different to FIG. 4. FIG. 7 is different in the feature of bi-directional printing in a case of being compared with FIG. 4. For example, passes with an even number (pass 2, 4, 6 . . . ) are realized using the return path movement. Accordingly, the first pass and the third pass out of the total of three passes using the nozzle groups G1, G2, and G3 for printing one band are outgoing path movements (or the return path movements) and the second pass is the return path movement (or the outgoing path movement). In addition, in FIG. 7, each of the masks are prepared in advance in order for the mask M1 to be for the nozzle group G1, the mask M2 to be for the nozzle group G2, and the mask M3 to be for the nozzle group G3. The proportion of "1" in the mask which is applied in the pass of the outgoing path movement and "1" in the mask which is applied in the pass of the return path movement is set to be substantially the same. Specifically, in the example of FIG. 7, the total of the proportion of "1" in the mask M1 and the mask M3 is approximately 50% (25%+25%) of the total pixels and the proportion of "1" in the mask M2 is approximately 50% of the total pixels.

According to FIG. 7, for example, the K ink halftone data for printing the band 1 is allocated so that the result of the mask M1 being applied (approximately 25% of the dots) is allocated to the K nozzle of the nozzle group G1 in pass 1 (the outgoing path movement), the result of the mask M2 being applied (approximately 50% of the dots) is allocated to the K nozzle of the nozzle group G2 in pass 2 (the return path movement), and the result of the mask M3 being applied (approximately 25% of the dots) is allocated to the K nozzle of the nozzle group G3 in pass 3 (the outgoing path movement). In addition, the same considerations are given to the other bands, and for example, the K ink halftone data for printing the band 2 is allocated so that the result of the mask M1 being applied (approximately 25% of the dots) is allocated to the K nozzle of the nozzle group G1 in pass 2 (the return path movement), the result of the mask M2 being applied (approximately 50% of the dots) is allocated to the K nozzle of the nozzle group G2 in pass 3 (the outgoing path movement), and the result of the mask M3 being applied (approximately 25% of the dots) is allocated to the K nozzle of the nozzle group G3 in pass 4 (the return path movement).

According to modified example 1, the total amount of the K ink which is discharged in the outgoing path movement and the total amount of the K ink which is discharged in the return path movement is substantially the same in band units. As a result, the ratio of area of the locations where the chromatic color ink lands after the K ink and the locations where the chromatic color ink lands before the K ink is substantially the same in the bands, and the color irregularities which are caused by the reversal as described above are not conspicuous due to being averaged out over the entire printing result.

In addition, also in the applied example 1, the amount of ink of the K ink which is discharged along with the Y ink with the highest brightness out of the chromatic color inks are the smallest (the same as the amount of ink of the K ink which is discharged along with the C ink). Accordingly, it is possible to avoid the color development of the Y ink with the highest brightness on the printing medium being suppressed more than necessary due to the considerable influence of the K ink which is discharged together with the Y ink.

Here, in the printer 50 which prints images using a plurality of passes by combining the transporting of the printing medium and the movement of the printing head 62 along the main scanning direction, it is not easy to completely match the transport amount in every time of transporting between the passes and slight errors accompany the transporting of the printing medium. In addition, localized expansion and contraction and the like of the printing medium occurs due to the landing of a liquid (the ink) and the medium changes to a shape which is slightly wavy. As a result, in a case where further printing is performed after printing using one of the nozzle groups with regard to one band using another of the nozzle groups through transporting of the printing medium, this causes errors in the transport amount and changes in shape of the printing medium and the next image is printed in a position which is deviated along the transport direction with regard to the image which has been previously printed. Furthermore, the positions of each of the images due to each of the passes do not completely match in the main scanning direction due to causes such as mechanical errors in the carriage 60 and the like in a case where images are printed using a plurality of passes with regard to one band (in particular, in a case of bi-directional printing).

Such positional deviation in the transport direction and positional deviation in the main scanning direction is linked to deterioration in image quality (blurring of the printing result) when printing is completed. In addition, since the positional deviation accumulates as the number of passes increases, it is easy for the positional deviations to most remarkably appear between images which are recorded in the first pass and the last pass. However, according to modified example 1, each of the amount of ink of the K ink which is discharged in the first pass with regard to one band (the amount of ink (=25%) where the mask M1 is applied to the K ink halftone data) and the amount of ink of the K ink which is discharged in the last pass (the amount of ink (=25%) where the mask M3 is applied to the K ink halftone data) is smaller than the amount of ink of the K ink which is discharged in the passes other than the first or the last passes with regard to one band (the amount of ink (=50%) where the mask M2 is applied to the K ink halftone data). As a result, the results of the positional deviation described above are not conspicuous even if the positional deviation described above is generated between the images which are recorded in the first pass and the last pass with regard to one band, and it is possible to alleviate influences on image quality due to the positional deviations described above (blurring in the printing result). That is, according to modified example 1, it is possible to obtain a sharper printing result and it is possible to obtain excellent image quality (sharp text) when printing text where, in particular, the K ink is often used.

Modified Example 2

Figure 8:
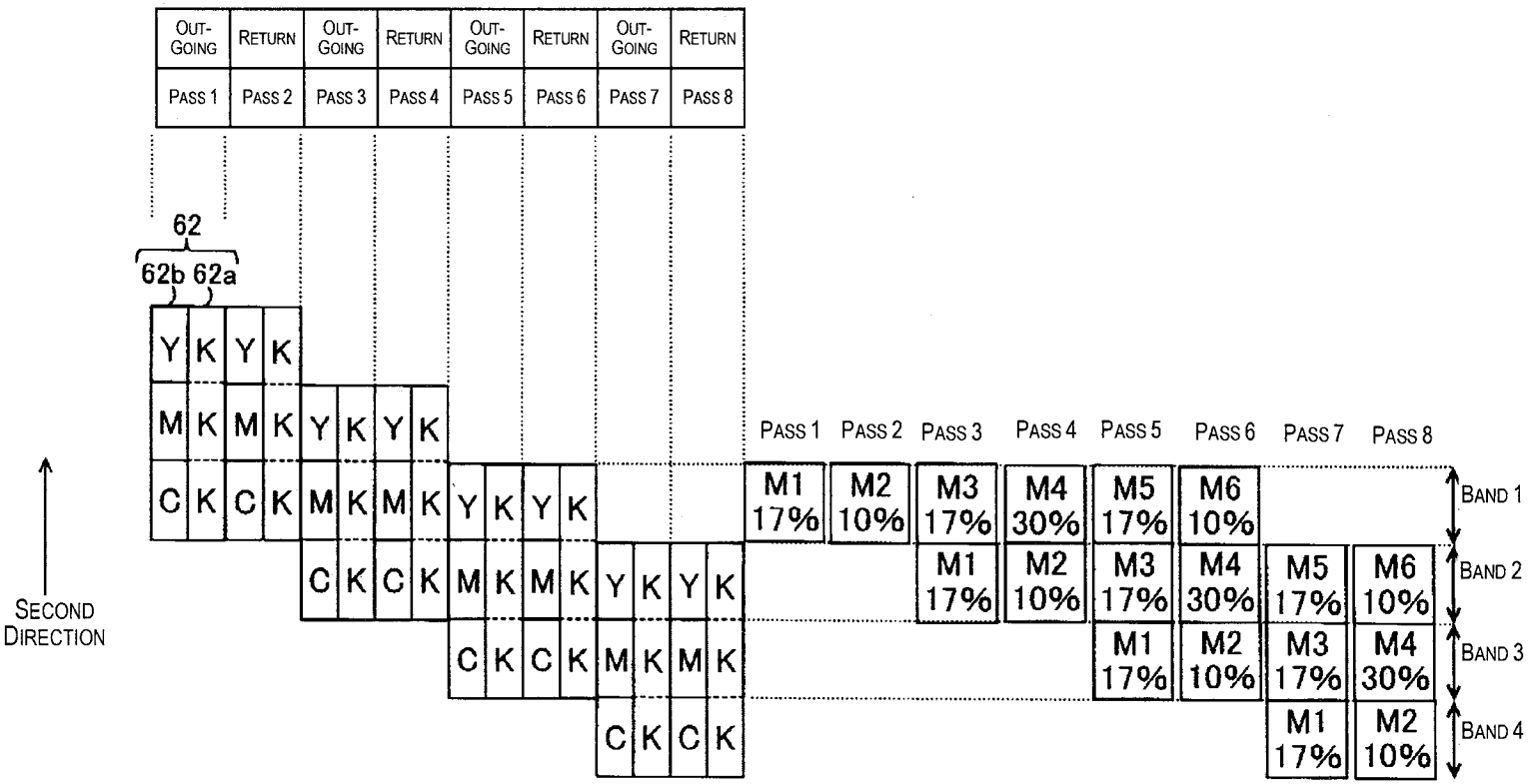
FIG. 8 is a diagram for describing another example of allocation of halftone data with regard to each pass and each nozzle.

FIG. 8 is a diagram for describing an example of allocation of the halftone data with regard to each pass and each nozzle of the printing head 62 and shows an example which is different to FIGS. 4 and 7. FIG. 7 is the same in the feature of bi-directional printing in a case of being compared with FIG. 7, but is different in the feature of printing one band with two passes using each of the nozzle groups G1, G2, and G3 (a total of six passes). For example, band 1 is printed using the nozzle group G1 in pass 1 (the outgoing path movement) and pass 2 (the return path movement), is printed using the nozzle group G2 in pass 3 (the outgoing path movement) and pass 4 (the return path movement), and is printed using the nozzle group G3 in pass 5 (the outgoing path movement) and pass 6 (the return path movement). In addition, in FIG. 8, each of the masks are prepared in advance so that the mask M1 is for the nozzle group G1 during the outgoing path movement and the mask M2 is for the nozzle group G1 during the return path movement. In the same manner, each of the masks are prepared in advance so that the mask M3 is for the nozzle group G3 during the outgoing path movement, the mask M4 is for the nozzle group G2 during the return path movement, the mask M5 is for the nozzle group G3 during the outgoing path movement, and the mask M6 is for the nozzle group G3 during the return path movement In the example of FIG. 8, each of the masks M1 to M6 are set so that the proportion of "1" in the mask which is applied in the pass of the outgoing path movement and "1" in the mask which is applied in the pass of the return path movement is set to be substantially the same. Specifically, the total of the proportion of "1" in the masks M1, M3, and M5 is approximately 50% (17%+17%+17%) of the total pixels and the total of the proportion of "1" in the masks M2, M4, and M6 is approximately 50% (10%+30%+10%) of the total pixels. According to FIG. 8, for example, the K ink halftone data for printing the band 1 is allocated so that the result of the mask M1 being applied (approximately 17% of the dots) is allocated to the K nozzle of the nozzle group G1 in pass 1 (the outgoing path movement), the result of the mask M2 being applied (approximately 10% of the dots) is allocated to the K nozzle of the nozzle group G1 in pass 2 (the return path movement), the result of the mask M3 being applied (approximately 17% of the dots) is allocated to the K nozzle of the nozzle group G2 in pass 3 (the outgoing path movement), the result of the mask M4 being applied (approximately 30% of the dots) is allocated to the K nozzle of the nozzle group G2 in pass 4 (the return path movement), the result of the mask M5 being applied (approximately 17% of the dots) is allocated to the K nozzle of the nozzle group G3 in pass 5 (the outgoing path movement), and the result of the mask M6 being applied (approximately 10% of the dots) is allocated to the K nozzle of the nozzle group G3 in pass 6 (the return path movement).

Even in modified example 2, the total amount of the K ink which is discharged in the outgoing path movement and the total amount of the K ink which is discharged in the return path movement is substantially the same in band units. As a result, the color irregularities which are caused by the reversal as described above are not conspicuous due to being averaged out over the entire printing result. In addition, even in modified example 2, the amount of ink of the K ink which is discharged along with the Y ink with the highest brightness out of the chromatic color inks are the smallest (the same as the amount of ink of the K ink which is discharged along with the C ink). Accordingly, it is possible to avoid the color development of the Y ink with the highest brightness on the printing medium being suppressed more than necessary due to considerable influence of the K ink which is discharged together with the Y ink. Furthermore, according to modified example 2 described above, it is possible to secure a comparatively longer time for drying each of the dots which are discharged onto the printing medium by printing a plurality of passes which is six passes for each one band and it is possible to obtain a printing result where the color development is excellent and there is minimal bleeding. Here, in the example of FIG. 8, the halftone data for each of CMY can be 100% allocated to any one pass in the plurality of passes (two passes) which are printed using the nozzle group which has the nozzles of the corresponding type of ink in one band or can be allocated to the plurality of passes.

Other:

As exemplified in FIG. 5, "1" in each of the masks M1, M2, and M3 which have been described up until here are disposed to be dispersed in the mask. For example, each of the locations where the landing order of the chromatic color ink and the non-chromatic color ink are reversed with each other exists in a random manner on the printing medium due to there being dispersion of the disposing of "1" in each of the masks M1, M2, and M3, and the color irregularities which are caused by the reversal are further alleviated.

Here, it is possible for the state of the disposing of "1" in each of the masks M1, M2, and M3 to be arbitrarily changed or the state of the disposing can have a certain degree of regularity. In addition, the specific numerical values which express the proportion of "1" in each of the masks M1, M2, and M3 which has been described up until here is only one example and it is possible to adopt various numerical values if the numerical values match the concept of the embodiment or the modified examples described above. For example, in modified example 1 described above, the proportion of "1" which are specified in the masks which are used in the allocation of the K ink in the first pass with regard to one band and the proportion of "1" which are specified in the masks which are used in the allocation of the K ink in the last pass with regard to the one band need not be the same.

Description has been performed where the case where the printing control process is executed by the computer 10 described above is an example, but the printing control process (which includes each of the modified examples) can be performed in the printer 50. That is, the flow chart of FIG. 3 can be realized by each of the functions described above such as the image data acquiring section 13*a*, the color conversion processing section 13*b*, the HT processing section 13*c*, and the rasterize processing section 13*d* being realized in the printer 50 due to the CPU 51 of the printer 50 executing the firmware FW (the printing control program). In this case, necessary information for the processes such as the masks M1, M2, and M3 are stored in advance in the ROM 53 in the printer 50. In addition, the CPU 51 receives various types of information and instructions, which are necessary for printing such as operations for the selection of the printing method (the selection of uni-directional printing or bi-directional printing and the like) and the printing execution instructions of the printing target image, from a user via the operation panel 59. As a result, the drive data is generated using the functions of the firmware FW as described above. Alternatively, the flow chart of FIG. 3 can be realized by being shared between the printer driver 13 and the firmware FW.

What is claimed is:

1. A printing device which prints onto a printing medium comprising:

a printing head;

a control section which moves the printing head in a scanning direction and relatively moves either of the head or the printing medium in a direction which intersects with the scanning direction; and a discharge control section, the printing head being provided with a plurality of color nozzle rows which are arranged to line up in the intersecting direction and discharge a plurality of color inks including yellow, cyan and magenta where a plurality of nozzles which discharge the same color of the color inks are arranged in the intersecting direction for each of the color nozzles rows, and a black ink nozzle row which is a nozzle row, which is arranged to line up with the color nozzle rows and discharges black ink, and which has a black ink nozzle group of the same number as the number of rows of the color nozzles, the discharge control section being configured to control such that the amount of black ink discharged from the black ink nozzle group which is arranged in a first color nozzle row which discharges yellow ink with the highest brightness out of the plurality of color inks with regard to a predetermined range on the printing medium which corresponds to the transport amount for each transportation for each movement of the printing head or the printing medium by the control section, is smaller than the amount of black ink, which is discharged from the black ink nozzle group which is arranged in a second color nozzle row which is different to the first color nozzle row, with the black ink being discharged from the black ink nozzle group along with discharging of color ink from either one of the color nozzle rows, the discharge control section being further configured to control such that the amount of ink which is discharged from the black ink nozzle group which is arranged to line up in the second color nozzle row where cyan ink is discharged with regard to the predetermined range is equal to or more than the amount of ink which is discharged from the black ink nozzle group which is arranged to line up in the first color nozzle row with regard to the predetermined range and is smaller than the amount of ink which is discharged from the black ink nozzle group which is arranged to line up in the second color nozzle row where magenta ink is discharged with regard to the predetermined range, and three masks including a first mask, a second mask, and a third mask, each of which specifies a different position of forming a dot, being used by switching such that the third mask is used to discharge the black ink along with discharging of the yellow ink, the first mask is used to discharge the black ink along with discharging of the cyan ink, and the second mask is used to discharge the black ink along with discharging of the magenta ink, with a dot forming proportion of the second mask being greater than a dot forming proportion of the first mask, the dot forming proportion of the first mask being greater than a dot forming proportion of the third mask, and the dot forming proportion of the third mask being greater than zero.

2. The printing device according to claim 1, wherein the printing head is able to discharge ink in each of an outgoing path movement and a return path movement along the first direction and sets the total amount of the amount of ink of the black ink which is discharged from the black ink nozzle row in accompaniment with the outgoing path movement with regard to the predetermined range to be substantially the same as the total amount of the amount of ink of the black ink which is discharged from the black ink nozzle row in accompaniment with the return path movement.

3. The printing device according to claim 1, wherein the control section executes a pass process, where chromatic color ink is discharged from either one of a plurality of the chromatic color nozzle rows along with discharging of black ink from the black ink nozzle row with regard to the predetermined range in accompaniment with the movement, with regard to the predetermined range a number of times which is an integer of the number of color inks, and each of the amount of ink which is discharged from the black ink nozzle row in the first pass process and the amount of ink which is discharged from the black ink nozzle row in the last pass process with regard to the predetermined range is smaller than the amount of ink which is discharged from the black ink nozzle group with regard to the predetermined range of at least one of the pass processes which is not the first or the last pass.

* * * * *